US006796441B2

(12) United States Patent
Tremblay

(10) Patent No.: US 6,796,441 B2
(45) Date of Patent: Sep. 28, 2004

(54) CREAM AND SUGAR DISPLAY STAND AND DISPENSER

(76) Inventor: Christian Tremblay, 105 Campagne, Cap-de-la-Madeleine, QC (CA), G8V 1J5

( * ) Notice: Subject to any disclaimer, the term of this patent is extended or adjusted under 35 U.S.C. 154(b) by 0 days.

(21) Appl. No.: 10/217,627

(22) Filed: Aug. 12, 2002

(65) Prior Publication Data

US 2003/0052071 A1 Mar. 20, 2003

(30) Foreign Application Priority Data

Aug. 15, 2001 (CA) ..... 2355064

(51) Int. Cl.[7] ..... A47B 73/00; A47F 7/00

(52) U.S. Cl. ..... 211/74; 211/14; 211/13.1; 211/71.01; 211/85.18; 211/78

(58) Field of Search ..... 211/74, 14, 13.1, 211/78, 70, 163, 71.01, 77, 85.18, 69.2, 66, 85.4; 206/446, 557, 562; D7/550.1, 553.1, 553.6–553.8, 553.2–553.5, 598, 600, 600.1–600.2, 619.1, 401.1; 220/569, DIG. 12, DIG. 14

(56) References Cited

U.S. PATENT DOCUMENTS

| | | | | | |
|---|---|---|---|---|---|
| 137,248 | A | * | 3/1873 | Shaw | 211/77 |
| 260,353 | A | * | 7/1882 | Banghart et al. | 211/77 |
| 353,554 | A | * | 11/1886 | Godfrey | 211/77 |
| D22,623 | S | * | 7/1893 | Weimer | D7/600 |
| 663,046 | A | * | 12/1900 | Schaeffer | 211/163 |
| 1,602,904 | A | * | 10/1926 | Jianas | 211/163 |
| 1,718,015 | A | * | 6/1929 | Weidner | 211/77 |
| 1,759,140 | A | * | 5/1930 | Silberger | 211/77 |
| D146,733 | S | * | 5/1947 | Ballard | D7/592 |
| D160,379 | S | * | 10/1950 | Finch | D6/464 |
| 2,946,456 | A | * | 7/1960 | Liquori | 211/77 |
| D232,341 | S | * | 8/1974 | Mudde | D7/501 |
| D233,584 | S | * | 11/1974 | Salviato | D7/592 |
| 3,964,629 | A | * | 6/1976 | McCabe | 220/23.86 |
| 4,011,954 | A | * | 3/1977 | Galli | 220/630 |
| D282,336 | S | * | 1/1986 | Collins | D7/600 |
| 4,915,239 | A | * | 4/1990 | Persch | 211/74 |
| 5,393,112 | A | * | 2/1995 | O'Connell | 294/143 |
| 5,641,080 | A | * | 6/1997 | Humphrey et al. | 211/77 |
| D392,852 | S | * | 3/1998 | Weterrings et al. | D7/706 |
| 5,894,943 | A | * | 4/1999 | Liu | 211/78 |
| 5,894,944 | A | * | 4/1999 | Swift | 211/78 |
| 6,505,747 | B1 | * | 1/2003 | Robertson | 211/74 |
| D469,659 | S | * | 2/2003 | Gale | D7/553.6 |
| D472,763 | S | * | 4/2003 | McGuyer | D7/401.1 |
| 2002/0170868 | A1 | * | 11/2002 | Morgan | 211/77 |

* cited by examiner

*Primary Examiner*—Jennifer E. Novosad
(74) *Attorney, Agent, or Firm*—Eric Fincham

(57) ABSTRACT

A holder for creamers having a tapered side wall, the holder comprising a housing having supporting members or feet extending downwardly therefrom, a plurality of openings in the housing, each being sized to retain a dairy creamer inserted therein, and a central opening located in a central portion of the housing such that a carrier may be used to transport a plurality of holders and the holder may be placed on a display stand at the table.

12 Claims, 4 Drawing Sheets

CREAM AND SUGAR DISPLAY STAND AND DISPENSER

FIELD OF THE INVENTION

The present invention relates to a display stand and more particularly, relates to a display stand suitable for use in a restaurant or the like for holding containers of cream and sugar.

BACKGROUND OF THE INVENTION

Coffee and tea are very popular drinks and are served by eating establishments of all types ranging from street vendors serving fast food through cafeterias and more traditional cafes and restaurants. Many drinkers of coffee and tea use a sweetener and a dairy product to mix in the coffee or tea. The sweetener may be either sugar or one of the commercially available synthetic sweeteners while the dairy products may include milk and/or cream. For simplicity, the terms cream and sugar will be used herein with it being understood that they will include the various options and alternatives thereto.

Typically, the sugar is dispensed in paper containers having individual portions while the cream is dispensed in a cup like container which is normally of a plastic and sealed on the top with a paper product lining.

To provide the small quantities of sugar or artificial sweeteners available to suit the individual taste of a given person is not a problem as the containers of the same may be safely stored at room temperature for long periods of time. However, whenever a dairy product such as milk or cream is utilized, it has a limited shelf life unless it is refrigerated. Typically, regulations call for a container of a dairy product not to be exposed to room temperature for more than six hours.

To keep the dairy products reasonably fresh, one option is to store them in a shallow bath of ice and water such as in an open top bowl or tray. While this is functional to extend the shelf life of the cream, sanitary problems can arise since anyone who has germs in his or her hand will soon contaminate the entire bath.

It has been proposed in the art to provide for refrigerated devices in which the small containers of the dairy product may be stored. Thus, there have been proposals in the art to use refrigeration devices to keep the containers of dairy products refrigerated. However, this is not practical when space is limited such as when they are placed at a table at which patrons are eating.

Accordingly, there is a requirement for an arrangement wherein the small dairy containers may be stored at a table or the like and wherein they are easy to replace and which provides a sanitary environment for the containers.

SUMMARY OF THE INVENTION

According to one embodiment of the present invention, there is provided a holder for creamers having a tapered side wall, the holder comprising a housing having a plurality of supporting members extending downwardly therefrom, the housing having a plurality of openings therein, each opening extending through the housing, each of the openings being sized to retain a dairy creamer inserted therein by engaging an upper portion of the tapered side wall thereof, and a central opening located in a central portion of the housing sized to receive a mounting member.

In greater detail, there is provided a system for storing, displaying and transporting creamers in a restaurant or like facility. In this respect, the word creamers is then to cover all small containers of a dairy product, whether they actually contain cream or some other milk or similar product. The containers are those which have a base and an outwardly tapering side wall such that the diameter at the top is greater than the diameter at the bottom. The opening is generally sealed with a flexible film material such as treated paper or plastic. In lieu of the tapered wall, there may be provided a rim at the outlet thereof.

The base member of the present invention comprises a holder which is preferably formed as an integral member, either of a plastic or a metallic material. In this respect, when formed of a plastic material, the product may be suitably molded while it is formed of a metallic material, bending operations may be employed.

The holder comprises a housing having feet or supporting members associated therewith for supporting the housing on both flat and other surfaces as will be discussed in greater detail hereinbelow. A portion of the housing has apertures formed therein, this portion of the housing being located sufficiently distant from the supporting members or feet such that a creamer may be inserted therein. At this end, each of the apertures is sized to have a diameter slightly less than the diameter of the creamer proximate the mouth portion thereof.

As aforementioned, the base member includes a plurality of receptacles therein. Preferably, there are at least two such receptacles, one being designed to receive sugar packets with the second receptacle being designed to receive utensils for stirring the beverage. In a particularly preferred embodiment, a third receptacle could be employed similar to the receptacle for the sugar packets—this third receptacle could be designed to receive artificial sweeteners or other products.

The upper portion of the holder is designed to receive individual creamers and to this end, will include a plurality of circular receptacles, each one being designed to receive a single creamer.

An advantage of the instant invention, particularly for the creamers, is the easy replacement of the same and being able to identify how many have been used.

The holder of the present invention is designed such that a plurality of such holders may be utilized. To this end, the supporting members are sized and situated such that a plurality of holders may be placed one on top of the other, each one being supported by the one underneath. The supporting members will preferably have an angled bottom surface or element such that they will seat properly on the holder below.

Preferably, there are also provided means for transporting a plurality of the holders, and to this end, there may be provided a carrier member which has an elongated body sized to fit within the central opening of the creamers similar to that of the post member.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
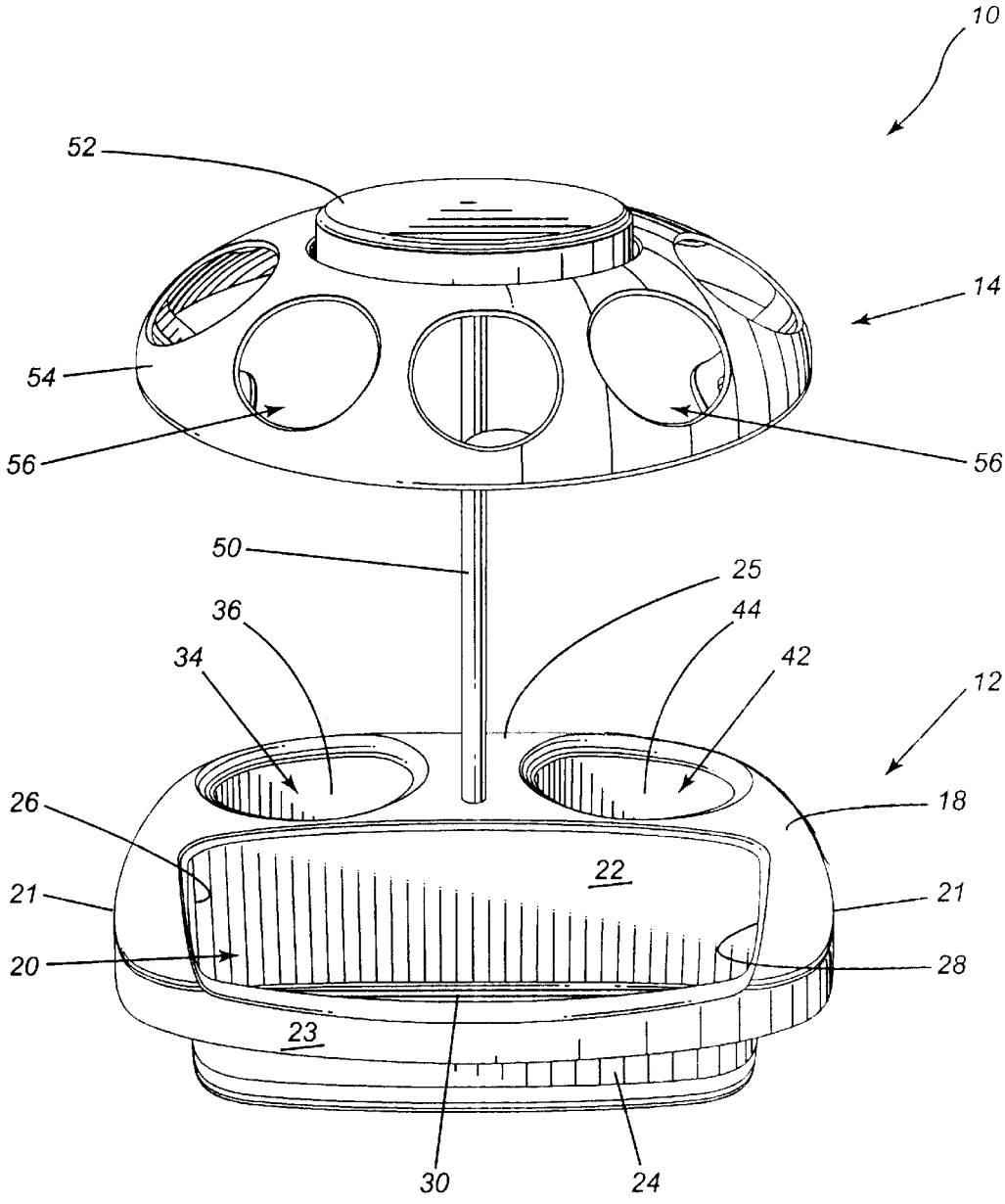
FIG. 1 is a top perspective view of a creamer holder according to the present invention.
Figure 2:
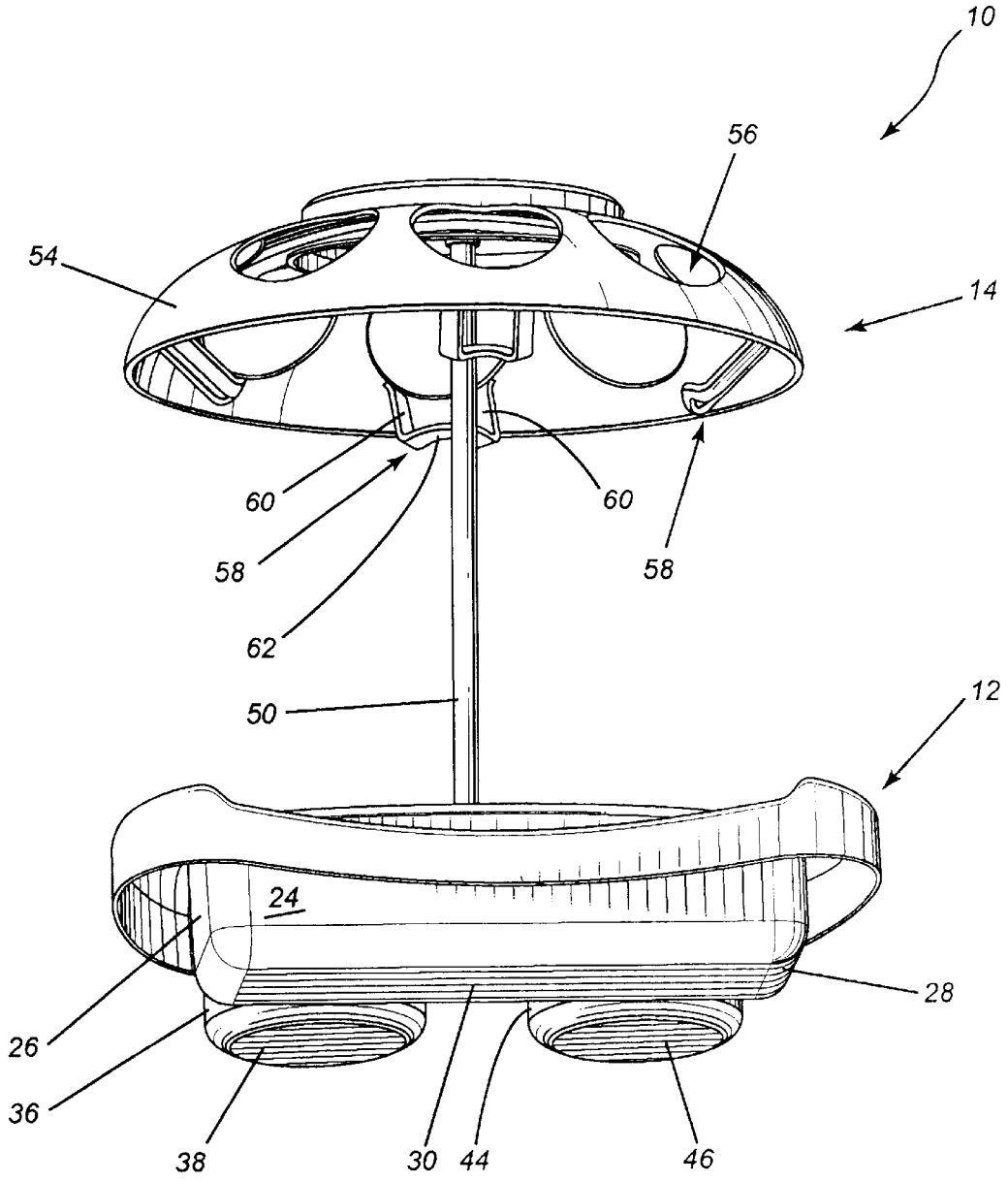
FIG. 2 is a bottom perspective view thereof.

Referring to the drawings in greater detail and by reference characters thereto, a display stand is generally designated by reference numeral 10.

Display stand 10 includes a base member generally designated by reference numeral 12, a holder generally designated by reference numeral 14 and a post 50 extending from base portion 12 to upper portion 14.

Base member 12 includes a base upper wall 18, a pair of side walls 21, a front wall 23, and a rear wall 25. Formed within base upper wall are a plurality of recesses or receptacles. Thus, there is provided a first generally rectangularly shaped recess or receptacle 20 which is defined by a pair of longer generally vertical opposed side walls 22 and 24, a pair of shorter generally vertical end walls 26 and 28, and a bottom wall 30.

In the illustrated embodiment, there is also provided a first cylindrical receptacle 34 which is defined by a generally circular side wall 36 and a bottom wall 38. Similarly, there is a second cylindrical receptacle generally designated by reference numeral 42 and which is defined by a generally circular side wall 44 and a bottom wall 46.

As aforementioned, there is provided a support member or post 50 which extends upwardly from base upper wall 18 intermediate receptacles 34 and 42 to an upper central portion 52 of holder 14. At the periphery of upper central portion 52 there is provided a housing 54 which extends downwardly and outwardly. Provided in housing 54 are a plurality of apertures 56 which are of a generally circular configuration and are designed to receive a creamer. Located underneath apertures 56 are downwardly extending support members or legs 58 which comprise a pair of opposed side elements 60 and a bottom element 62. Thus, bottom element or surface 62 is angled such that a plurality of holders 14 may be placed one on top of another with bottom element 62 being angled to seat properly on housing 54.

An alternative embodiment of the above may include an arrangement wherein the support member 50 is removed and provision is made for containing the sugar and/or other materials in upper central portion 52.

Figure 3:
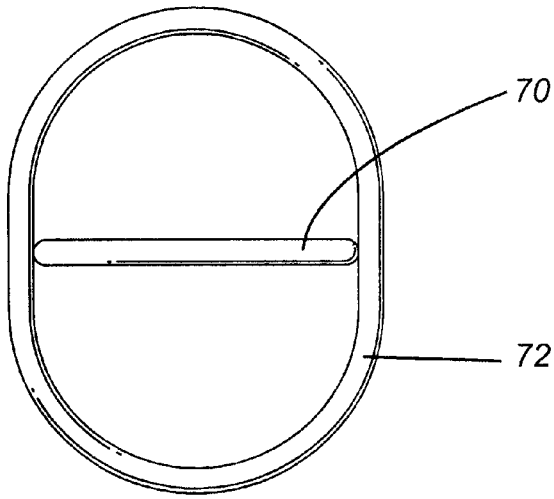
FIG. 3 is a top plan view of a carrier member for transporting the holders.
Figure 4:
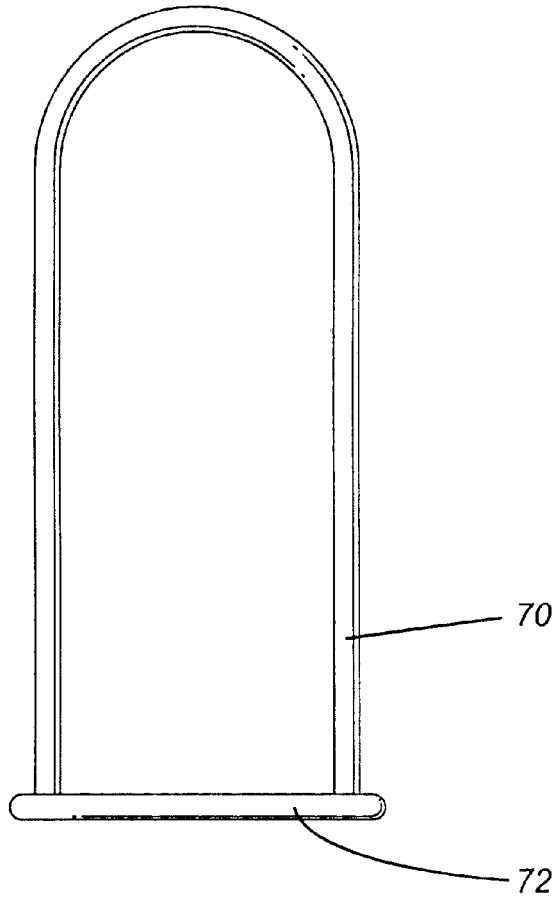
FIG. 4 is a side elevational view thereof.
Figure 5:
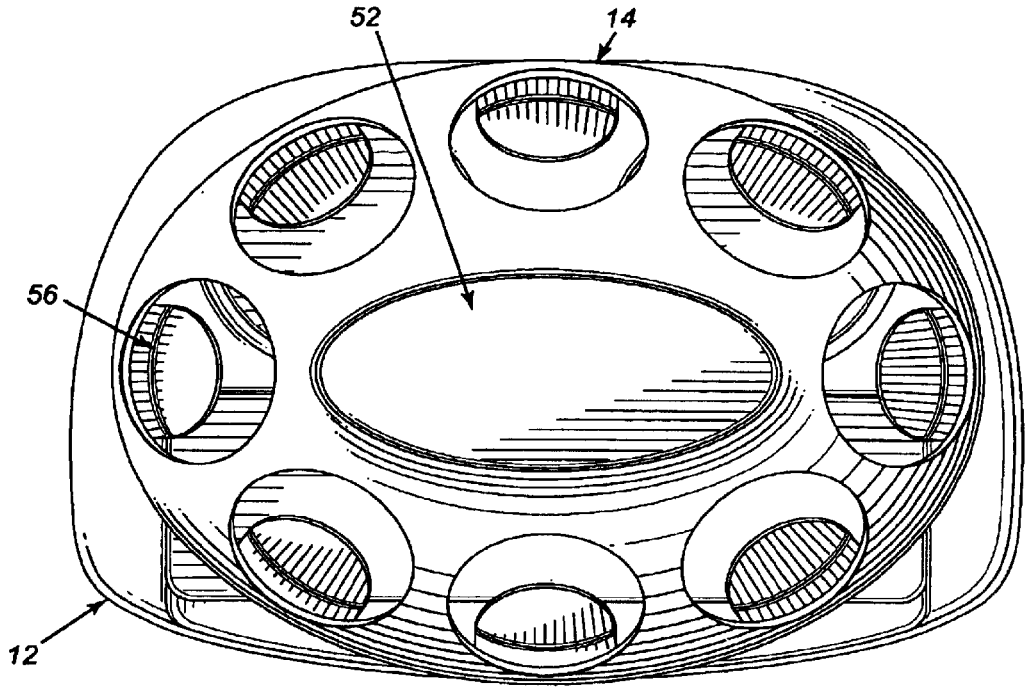
FIG. 5 is a top plan view of a creamer holder according to the present invention.

As may be seen in FIGS. 3 and 4, a carrier may be provided for transporting a plurality of the holders. To this end, the carrier may simply comprise a U-shaped handle member 70 having a bottom support ring 72 sized to fit within the central aperture of holder 14 in a manner similar to that previously described.

Figure 6:
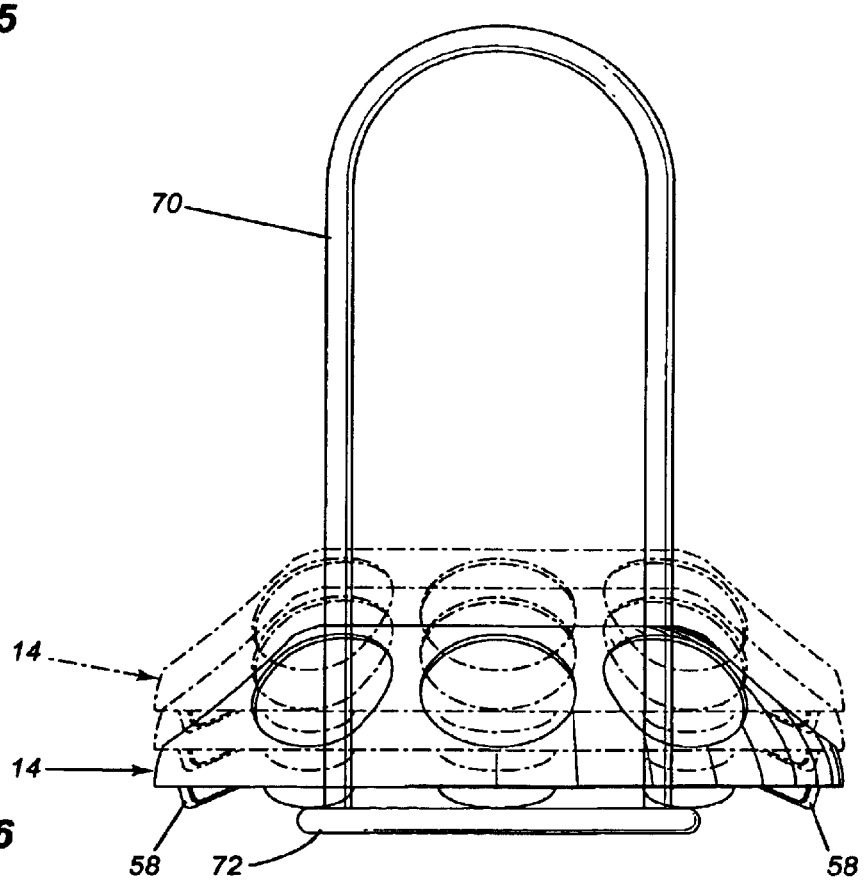
FIG. 6 is a side elevational view showing the carrier with a plurality of the holders.

As shown in FIG. 6, the holders are stacked on top of one another with support members or legs 58 spacing one holder from another.

It will be understood that the above described embodiment is for purposes of illustration only and changes and modifications may be made thereto without departing the spirit and scope of the invention.

I claim:

1. A holder for creamers having a tapered side wall, said holder comprising:

a generally ovally shaped housing joined to said tapered side wall and having a plurality of supporting members extending downwardly from said tapered side wall;

said housing having a plurality of apertures therein, each of said apertures extending through said housing;

each of said apertures being sized to retain a dairy creamer inserted therein by engaging an upper portion of said tapered side wall thereof; and a central opening located in a central portion of said housing, said central opening having an oval configuration.

2. The holder of claim 1 wherein said housing has a dome shaped configuration defined by a wall extending downwardly and outwardly from said central opening, said apertures being formed in said wall.

3. The holder of claim 2 wherein said supporting members extend downwardly and inwardly to form an angled bottom surface, said angled bottom surface being adapted to rest on the downwardly sloping portion of a like holder housing when placed on top thereof, said supporting members adapted to space said housing from the like holder housing on which said housing is adapted to rest to provide room for said creamers.

4. The holder of claim 1 wherein said housing is formed of a molded plastic material.

5. The holder of claim 1 further including a base member, said base member having at least one recess formed therein to receive a commodity, a post extending upwardly from said base member, said post having an enlarged upper end sized to fit within said central opening to thereby support said housing.

6. The holder of claim 5 further including a plurality of recesses formed in said base member.

7. The holder of claim 6 wherein said base member has a substantially rectangular configuration defined by a front wall, a rear wall, and a pair of side walls, a first generally rectangular recess being formed in said base member adjacent said front wall, and a pair of generally circular recesses being formed in said base member adjacent said rear wall.

8. The holder of claim 7 wherein said post extends upwardly from intermediate said pair of circular recesses.

9. The holder of claim 7 further including a horizontal flange portion extending outwardly from said rear wall, and a generally vertical flange extending upwardly from a distal end of said horizontal flange portion to define a holder portion between said rear wall and said upwardly extending flange.

10. In combination, a plurality of holders as defined in claim 1, and further including a carrier for carrying a plurality of said holders, said carrier having an elongated body of a configuration sized to fit within said central opening of each of said housings and as to retain said creamers thereon.

11. A holder for creamers having a tapered side wall, said holder comprising:

housing having a dome shaped configuration defined by a wall extending downwardly and outwardly and joined at a bottom thereof to said tapered side wall; said housing having a plurality of supporting members extending downwardly from said tapered side wall;

a plurality of apertures formed in said downwardly and outwardly extending wall, each of said apertures being sized to retain a dairy creamer inserted therein by engaging an upper portion of said tapered side wall thereof.

12. The holder of claim 11, wherein said supporting members extend downwardly and inwardly to form an angled bottom surface, said angled bottom surface being adapted to rest on the downwardly sloping wall of a like holder when placed on top thereof, said supporting members adapted to space said wall from the like holder wall on which said housing is adapted to rest to provide room for said creamers.

* * * * *